US011345579B2

(12) United States Patent
Varme

(10) Patent No.: US 11,345,579 B2
(45) Date of Patent: May 31, 2022

(54) AUTOMATIC WINE BOTTLE OPENER

(71) Applicant: Byron Kahrs Varme, Houston, TX (US)

(72) Inventor: Byron Kahrs Varme, Houston, TX (US)

( * ) Notice: Subject to any disclaimer, the term of this patent is extended or adjusted under 35 U.S.C. 154(b) by 0 days.

(21) Appl. No.: 17/402,558

(22) Filed: Aug. 15, 2021

(65) Prior Publication Data

US 2022/0048749 A1 Feb. 17, 2022

Related U.S. Application Data

(60) Provisional application No. 63/066,178, filed on Aug. 15, 2020.

(51) Int. Cl.
*B67B 7/04* (2006.01)

(52) U.S. Cl.
CPC ..... *B67B 7/0405* (2013.01); *B67B 7/0411* (2013.01)

(58) Field of Classification Search
CPC ... B67B 7/0405; B67B 7/0417; B67B 7/0435; B67B 7/0441; B67B 7/0447
USPC ..... 81/3.32, 3.36, 3.45
See application file for complete search history.

(56) References Cited

U.S. PATENT DOCUMENTS

| | | | | |
|---|---|---|---|---|
| 3,812,742 | A * | 5/1974 | Polasek | B67B 7/182 81/3.32 |
| 4,253,351 | A | 3/1981 | Allen | |
| 4,276,789 | A | 7/1981 | Allen | |
| 4,291,597 | A | 9/1981 | Allen | |
| 4,377,096 | A | 3/1983 | Allen | |
| 4,429,444 | A | 2/1984 | Allen | |
| 5,899,122 | A * | 5/1999 | Court | B67B 7/0405 81/3.2 |
| 8,011,276 | B2 | 9/2011 | Varme | |
| 2004/0194580 | A1* | 10/2004 | Dubois | B67B 7/182 81/3.2 |
| 2017/0158477 | A1* | 6/2017 | Varme | B67B 7/0405 |

FOREIGN PATENT DOCUMENTS

| | | | |
|---|---|---|---|
| CN | 108455510 | A * | 8/2018 |
| CN | 109279555 | A * | 1/2019 |

OTHER PUBLICATIONS

Wine Winch https://www.franmara.com/index.php/web-exclusives/wine-winch-professional-uncorking-machine-a-web-exclusive (Last Visited Aug. 15, 2021).

* cited by examiner

*Primary Examiner* — David B. Thomas
*Assistant Examiner* — Aaron R McConnell

(57) ABSTRACT

Disclosed herein is an automatic wine bottle opener the top assembly having an uncorking assembly wherein the electric motor is arranged proximate to a side of the uncorking mechanism such that the electric motor is not colinear with and/or located directly on top of the uncorking mechanism; and having a removable platform.

17 Claims, 7 Drawing Sheets

AUTOMATIC WINE BOTTLE OPENER

REFERENCE TO RELATED APPLICATIONS

The present application claims priority to U.S. Provisional Application No. 63/066,178, filed Aug. 15, 2020, the contents of which are hereby expressly incorporated by reference herein.

BACKGROUND

The statements in this section merely provide background information related to the present disclosure and may not constitute prior art.

Corkscrews for removing the cork from a wine bottle and the like have been available for at least two centuries. S. Henshall patented an auger-type corkscrew in 1895 and the basic concept has not changed since that time. Numerous improvements have been made over the years. Various references directed to corkscrews are known including U.S. Pat. Nos. 4,291,597, 4,253,351, 4,276,789, 4,377,096, 4,429,444, and many others. In addition, U.S. Pat. No. 8,011,276 is directed to mounting of a wine opening apparatus in a housing. U.S. Patent Publication No. 2017/0158477 is generally directed to an automatic wine bottle opening apparatus in which the wine bottle opener is mounted in a housing. However, the various shapes and sizes of available wine bottles results in such automatic devices being impractical to accomplish the task of uncorking the wine bottle due to a number of issues. Furthermore, the placement of the motor on top of the decorking mechanism results in the device having an inconvenient height and a relatively high center of gravity thus requiring a relatively large base to provide stability. There is a need in the art to provide an automatic or semi-automatic wine bottle opener capable of accommodating a wide range of wine bottles and solving other needs in the art.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In embodiments, a wine bottle opener for removing a cork from a wine bottle, comprises: a base, and a top assembly engaged with the base by a plurality of support members such that the top assembly is located a distance above the base sufficient to allow a standard wine bottle to be disposed between the base and the top assembly; the top assembly comprising an uncorking assembly comprising an electric motor mechanically coupled to an uncorking mechanism, wherein the electric motor is arranged proximate to a side of the uncorking mechanism such that the electric motor is not colinear with and/or located directly on top of the uncorking mechanism; and a control assembly in electronic communication with the uncorking assembly suitable to effect and control actuation and operation of the uncorking mechanism.

BRIEF DESCRIPTION OF THE SEVERAL VIEWS OF THE DRAWINGS

Embodiments of the wine bottle opener are described with reference to the following figures. The same numbers are used throughout the figures to reference like features and components.

DETAILED DESCRIPTION

Figure 1:
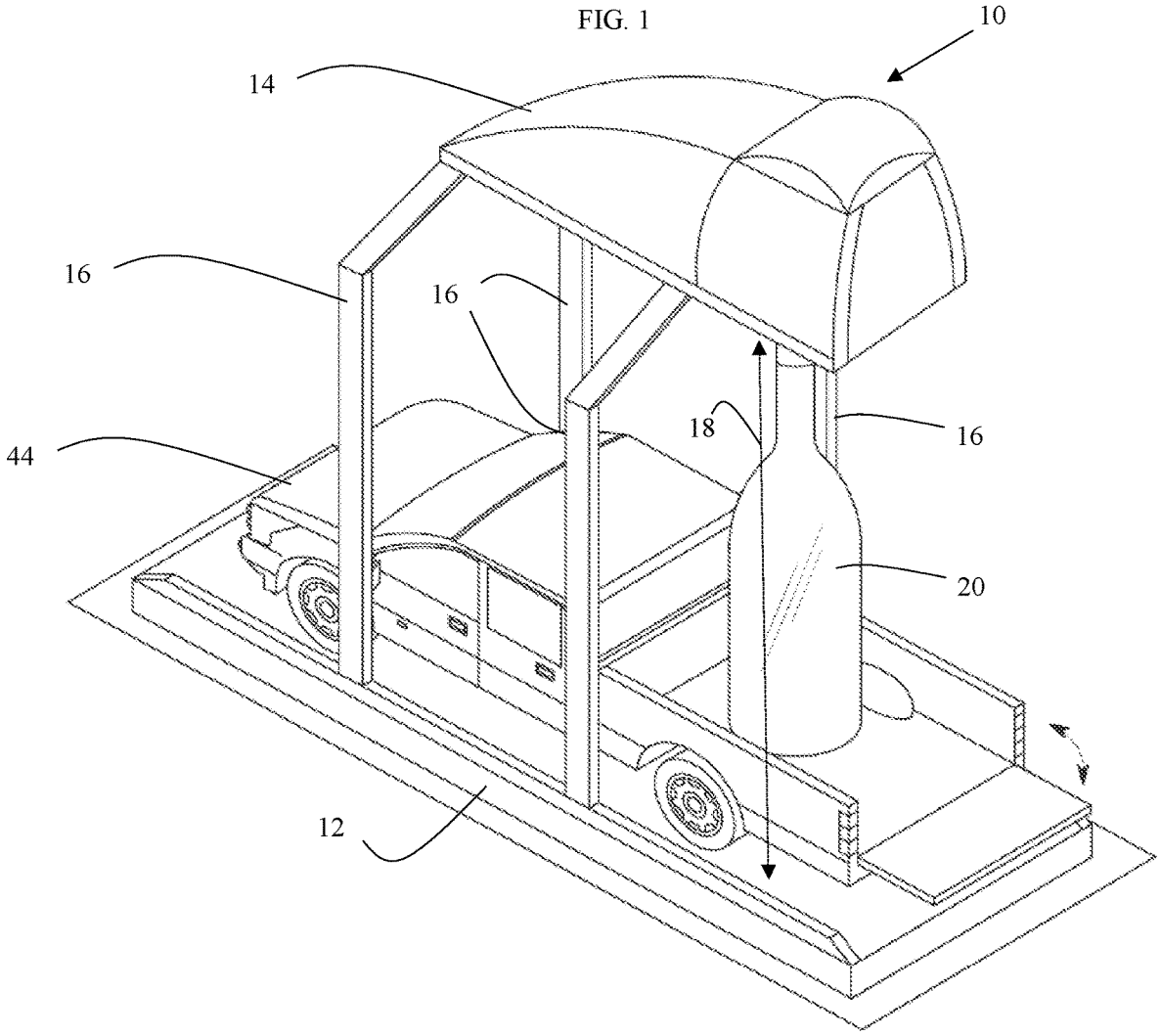
FIG. 1 is a top perspective view of a wine bottle opener according to embodiments disclosed herein.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context.

The following definitions are provided in order to aid those skilled in the art in understanding the detailed description.

As used in the specification and claims, "near" or "proximate" is inclusive of "at."

For purposes herein, it is to be understood that a wine bottle refers to any bottle or container made of glass, metal, a polymer, or a combination thereof, which is sealed with a cork as is readily understood in the art, which is suitable for holding wine, or any other beverage. Accordingly, a wine bottle includes any corked or otherwise sealed container suitable for holding wine, champagne, juice, carbonated liquids, a liquor, and/or any other aqueous liquid according to common understanding in the art.

For purposes herein, a standard wine bottle holds about 750 ml or less and has a bottom diameter (indicated as "W" in FIG. 3) of less than or equal to about 3.5 inches (~9 cm) and a height (indicated as "H" in FIG. 3) of less than or equal to about 12.5 inches (~32 cm). However, it is to be understood that the wine bottle opener according to embodiments disclosed herein is not limited to opening wine, but is contemplated to be suitable for use with any size bottle, closed with a removable stopper, used to hold any aqueous liquid consumed by human beings (e.g., champagne, beer, fruit juice, liquors, flavored water, soda, and the like.

In embodiments, a wine bottle opener for removing a cork from a wine bottle, comprises: a base, and a top assembly engaged with the base by a plurality of support members such that the top assembly is located a distance above the base sufficient to allow a standard wine bottle to be disposed between the base and the top assembly; the top assembly comprising an uncorking assembly comprising an electric motor mechanically coupled to an uncorking mechanism, wherein the electric motor is arranged proximate to a side of the uncorking mechanism such that the electric motor is not colinear with and/or located directly on top of the uncorking mechanism; and a control assembly in electronic communication with the uncorking assembly suitable to effect and control actuation and operation of the uncorking mechanism.

In some embodiments, the wine bottle opener further comprises a platform disposed between the base and the top assembly, comprising an essentially planer portion positioned directly between the base and the uncorking mechanism, the essentially plane portion being dimensioned to allow at least a portion of a bottom of a standard wine bottle to be disposed thereon. In some embodiments, the platform comprises, or consists of a scale model of at least a portion of a truck motor vehicle. In embodiments, the essentially planer portion of the platform is at least partially provided by a cargo bed area of the truck motor vehicle scale model. In some of such embodiments, the platform is removably engaged with the base.

In embodiments, at least a portion of the platform is disposed between at least two of the plurality of support members. In one or more embodiments, at least a portion of the top assembly is movably engaged with another portion of the top assembly and/or at least one support member, such that at least a portion of the top assembly is movable between an upper position relative to the base, and a lower position which is closer to the base than the upper position. In some of such embodiments, at least a portion of the top assembly is movably engaged with another portion of the top assembly and/or at least one support member and is biased by a resilient member such that in the absence of an external force on the at least a portion of the top assembly, the top assembly is in the upper position, and upon application of the external force on the at least a portion of the top assembly towards the base, the at least a portion of the top assembly moves toward the base to the lower position.

In one or more embodiments, the top assembly comprise a stationary portion engaged with at least one support member, and a movable portion movably engaged with the stationary portion. In one or more embodiments, the movable portion is movably engaged with at least one support member. In alternative embodiments, the entire top assembly is movably engaged with at least one support member.

In one or more embodiments, the wine bottle opener further comprises an electric power storage device, a rechargeable electric storage device, or a combination thereof, in electrical communication with the control assembly, the uncorking assembly, or both. In some embodiments, the electric power storage device is located on, under, or at least partially within the base. In other embodiments, the electric power storage device is located on or at least partially within the top assembly.

In embodiments, the wine bottle opener comprises at least one adjustable support member having an adjustable length, such that the distance between the base and the top assembly is adjustable between a first distance and at least one second distance greater than the first distance. In some of such embodiments, the at least one adjustable support member comprises a releasably engageable telescoping portion allowing for adjustment of the length of the support.

As shown in FIG. 1, in embodiments, a wine bottle opener for removing a cork from a wine bottle, generally indicated as 10, comprises a base 12, and a top assembly 14 engaged with the base by a plurality of support members 16 such that the top assembly 14 is located a distance 18 above the base 12 sufficient to allow a standard wine bottle 20 to be disposed between the base 12 and the top assembly 14. In embodiments, the top assembly 14 comprises an uncorking assembly 22 (See FIG. 2) comprising an electric motor 24 mechanically coupled 26, e.g., via gears, a belt and pully system and/or the like to an uncorking mechanism 28, e.g. comprising a cork screw and the like, as is common in the art. In embodiments, the electric motor 24 is arranged proximate to at least one side 30 of the uncorking mechanism 28 such that the electric motor 24 is not colinear with and/or located directly on top of the uncorking mechanism 28. The apparatus further includes a control assembly 32 (See FIG. 7) in electronic communication as indicated by dotted lines 34, with the uncorking assembly 22, and/or a power supply 36. The control assembly 32 is suitable to effect and control actuation and operation of the uncorking mechanism 28. In embodiments, the control assembly includes a triggering mechanism 38 positioned within or proximate to the uncorking mechanism 28 such that insertion of a wine bottle into the uncorking mechanism triggers the uncorking mechanism to uncork the bottle.

In the embodiment, as shown in FIGS. 2, 5A, 5B, and 5C, the motor 24 and the uncorking mechanism 28 are mechanically coupled by a linkage 26. This allows the motor 24 to be located proximate to, but not on top of or integral to the uncorking mechanism 28 thus lowering the overall height of the device. However, embodiments are also contemplated wherein the motor 24 is concentrically arranged around and/or integral to the uncorking mechanism (not shown).

The uncorking mechanism 28 comprises a bottle top receiver 40 adapted to receive an end, e.g., a corked end of a wine bottle 20. The uncorking mechanism 28 is generally understood in the art and includes an input shaft such that rotation of the input shaft by the motor 24 results in extension of the spiral corkscrew 42 towards the base 12, engagement of the spiral cork screw with a cork located at least partially within the end of the wine bottle 20, lifting of the cork relative to the wine bottle 20 in an amount effective to remove the cork from the wine bottle as is readily understood in the art.

Figure 7:
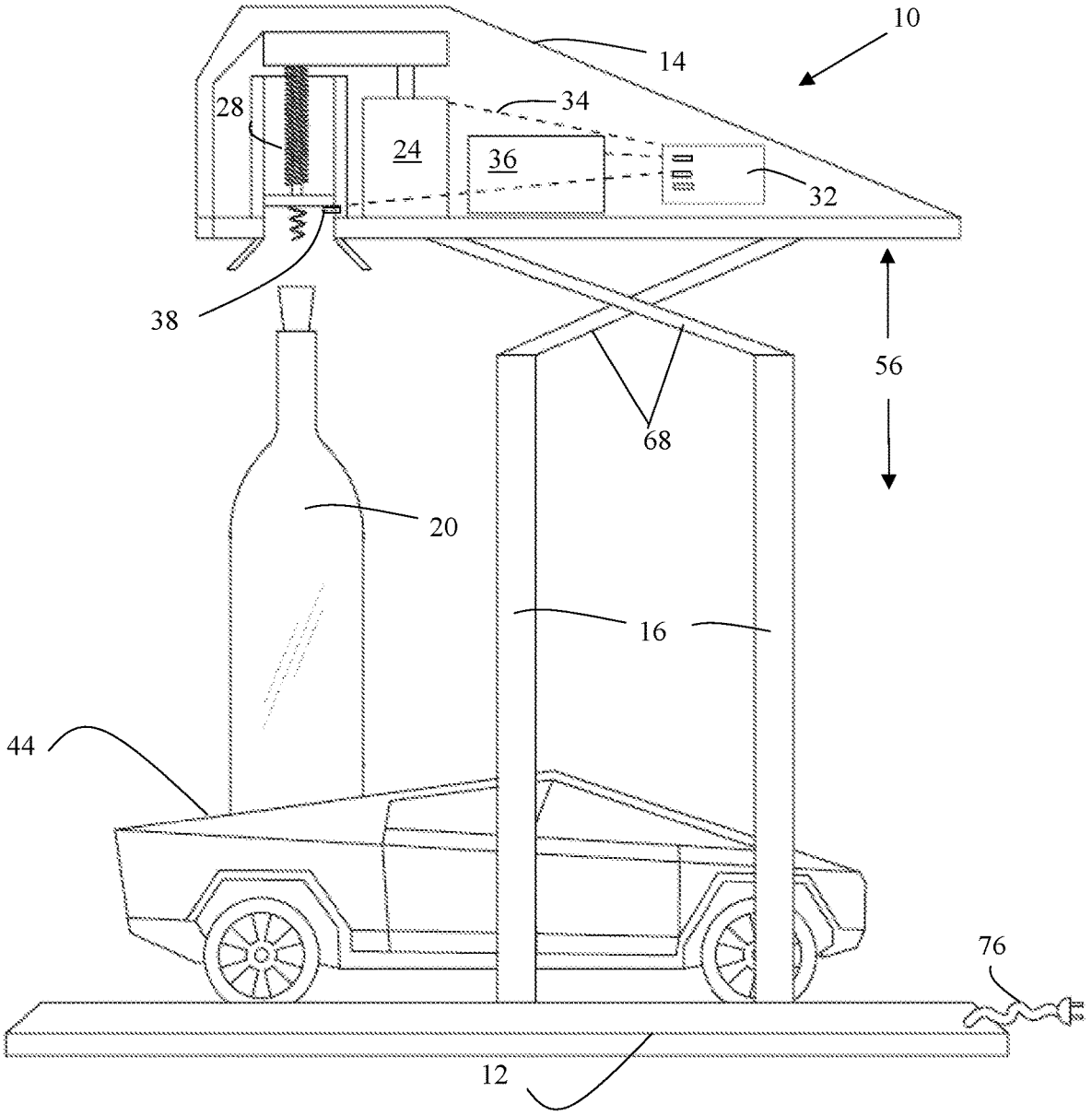
FIG. 7 is a side partial cutaway view of a wine bottle opener equipped with a model truck as the platform according to embodiments disclosed herein.

In an embodiment, as shown in FIG. 7, the wine bottle opener 10 further includes a control assembly 32 in electronic communication (indicated by dotted lines 34) with the motor 24 and/or the uncorking mechanism 28 and a power supply 36 suitable to effect and control actuation and operation of the uncorking mechanism thus removing of the cork from the wine bottle 20. The control assembly may be separate from the uncorking mechanism 22 or may be integral to the uncorking mechanism 22.

Figure 2:
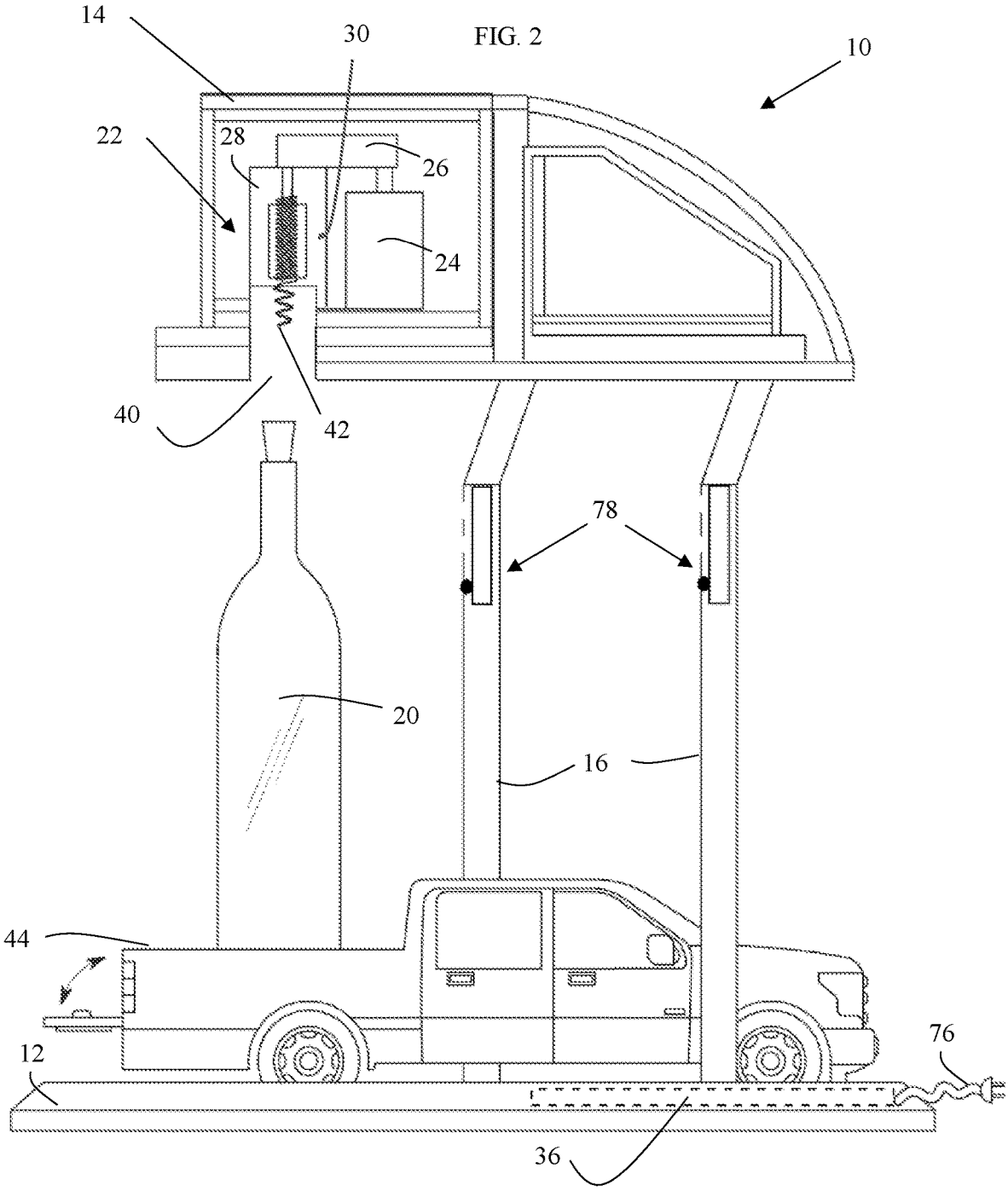
FIG. 2 is a side partial cut-away view of a wine bottle opener according to embodiments disclosed herein.
Figure 3:
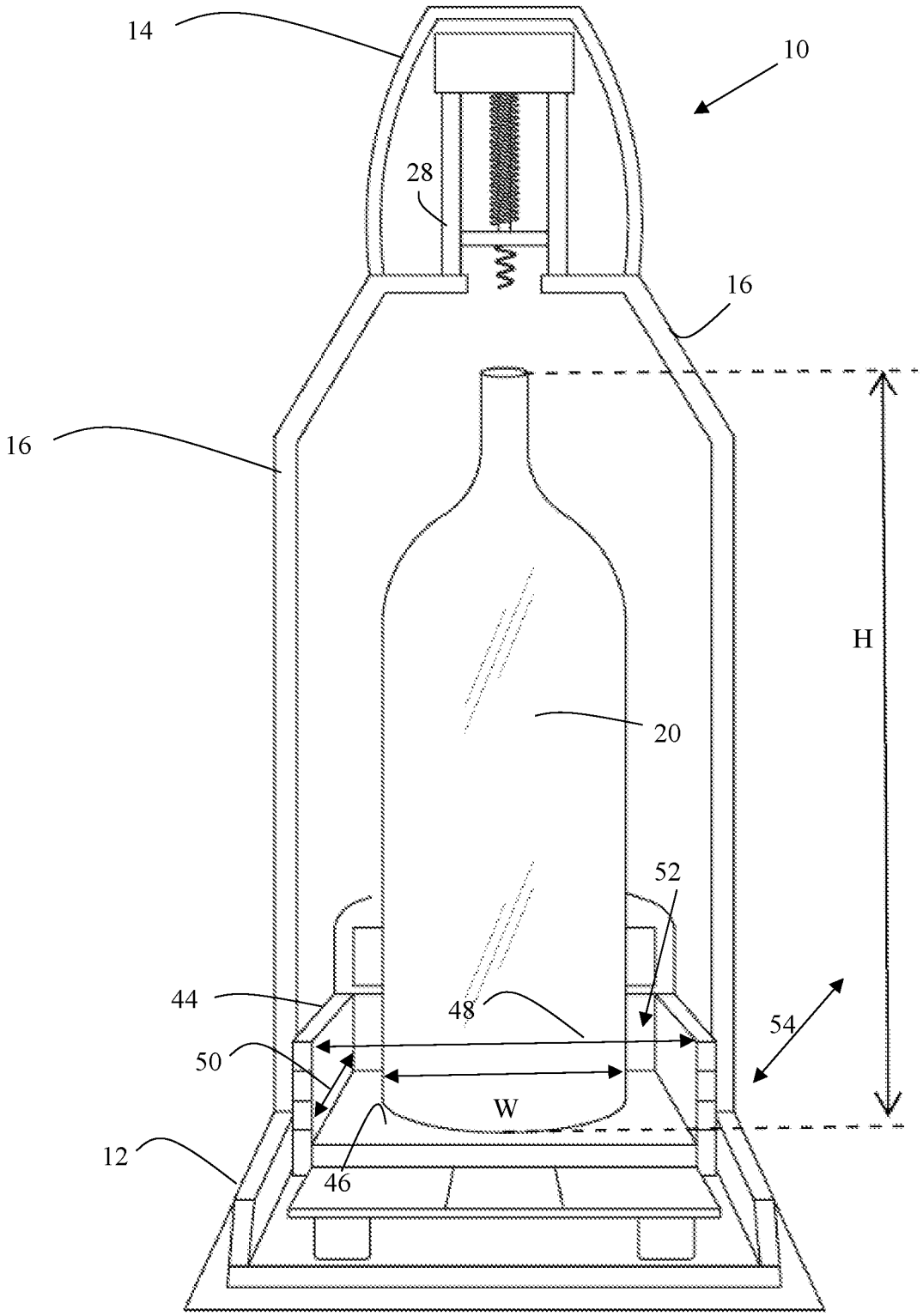
FIG. 3 is a rear facing view of a wine bottle opener according to embodiments disclosed herein.
Figure 4:
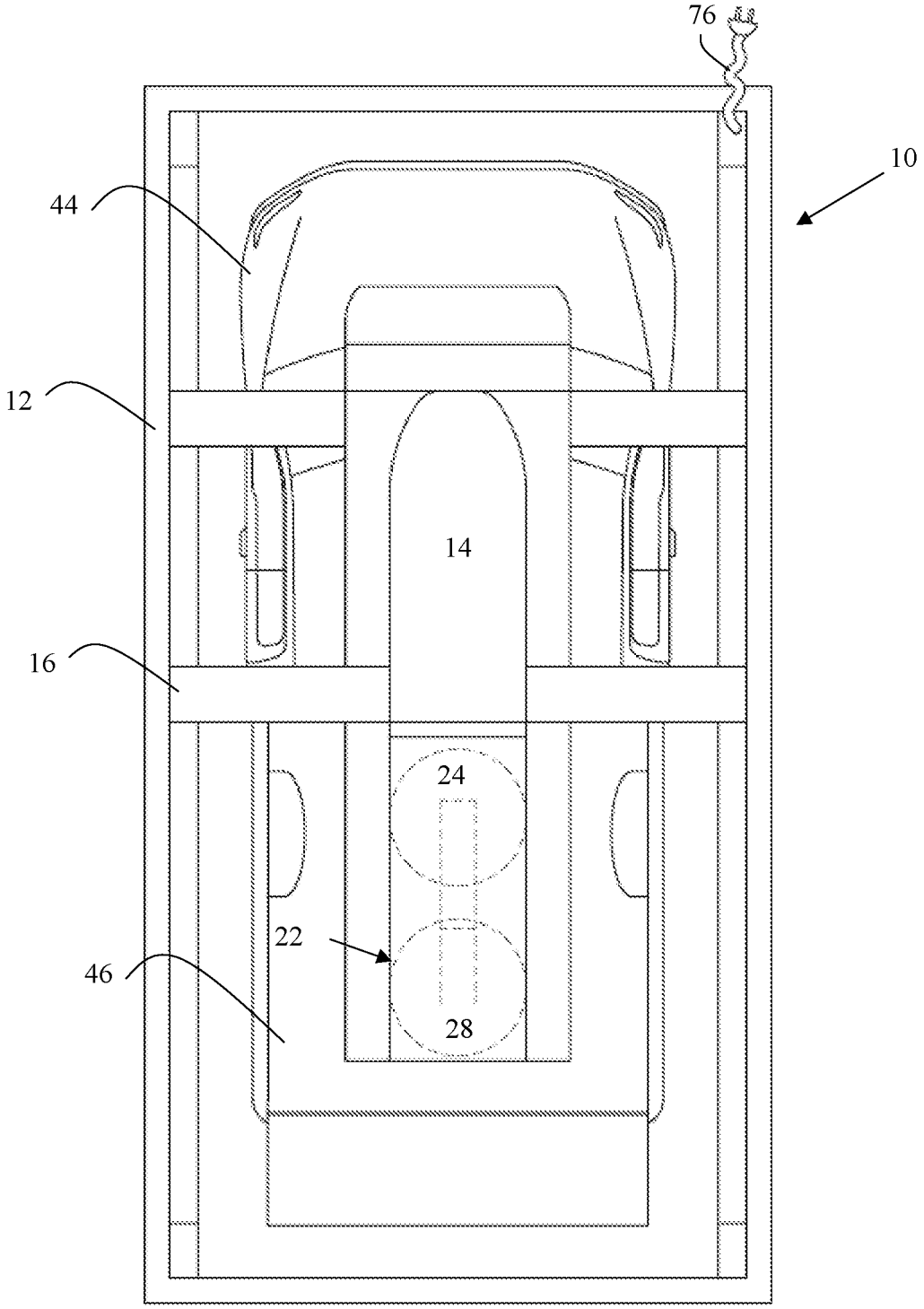
FIG. 4 is a top downward view of a wine bottle opener according to embodiments disclosed herein.
Figure 5A:
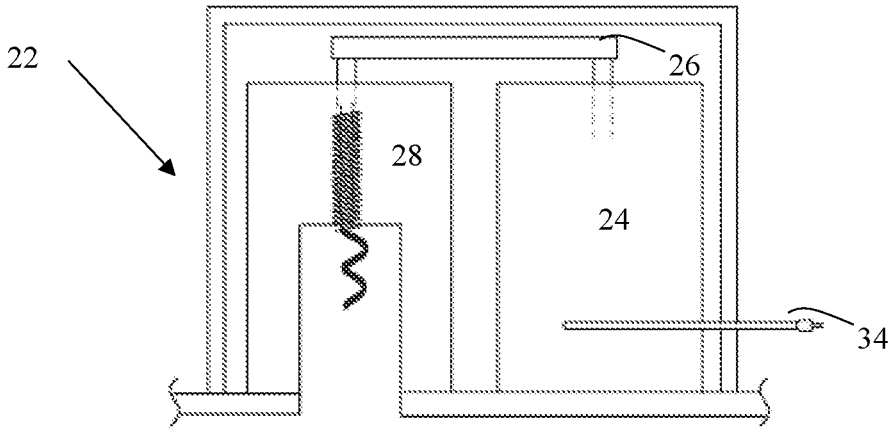
FIG. 5A is a side on partial cutaway view of an uncorking assembly of the wine bottle opener according to embodiments disclosed herein.
Figure 5B:
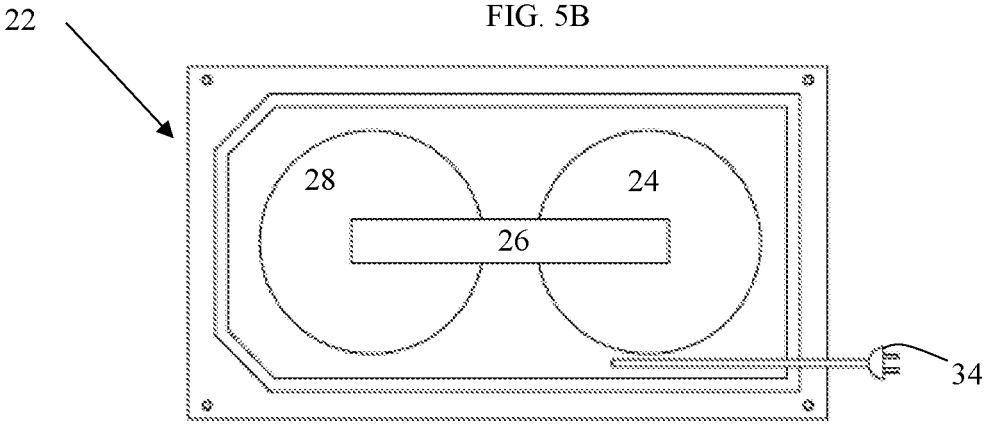
FIG. 5B is a top down partial cutaway view of an uncorking assembly of the wine bottle opener according to embodiments disclosed herein.
Figure 5C:
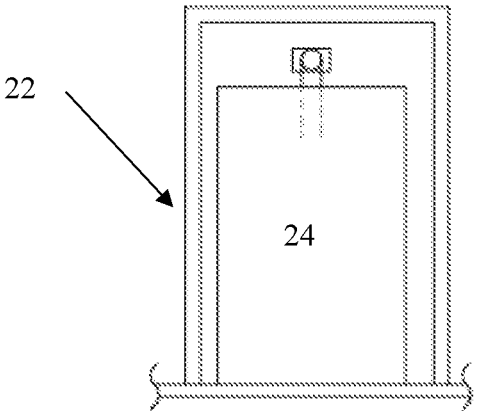
FIG. 5C is a rear partial cutaway view of an uncorking assembly of the wine bottle opener according to embodiments disclosed herein.

As shown in FIGS. 2, 3, and 4, in embodiments, the wine bottle opener 10 further comprising a platform 44 disposed between the base 12 and the top assembly 14, comprising an essentially planer portion 46 positioned directly between the base 12 and the uncorking mechanism 28. The essentially planer portion 46 being dimensioned i.e., having a width 48 and a length 50 large enough to allow at least a portion of a bottom of a standard wine bottle 20 to be disposed thereon. In embodiments, the platform 44 comprises, or is a scale model of at least a portion of a truck or other motor vehicle, and wherein the essentially planer portion 46 of the platform 44 is at least partially provided by the cargo bed 52 of the truck motor vehicle scale model. In embodiments, the platform 44, e.g., the scale model of the vehicle, is removably engaged with the base, as indicated by arrow 54, such that the base may accommodate a plurality of like-sized models according to the end-user's choice.

As shown in FIG. 4, in embodiments, at least a portion of the platform 44 is disposed between at least two of the plurality of support members 16, which in embodiments gives the appearance of vehicle under a covered parking area or in a garage setting.

Figure 6A:
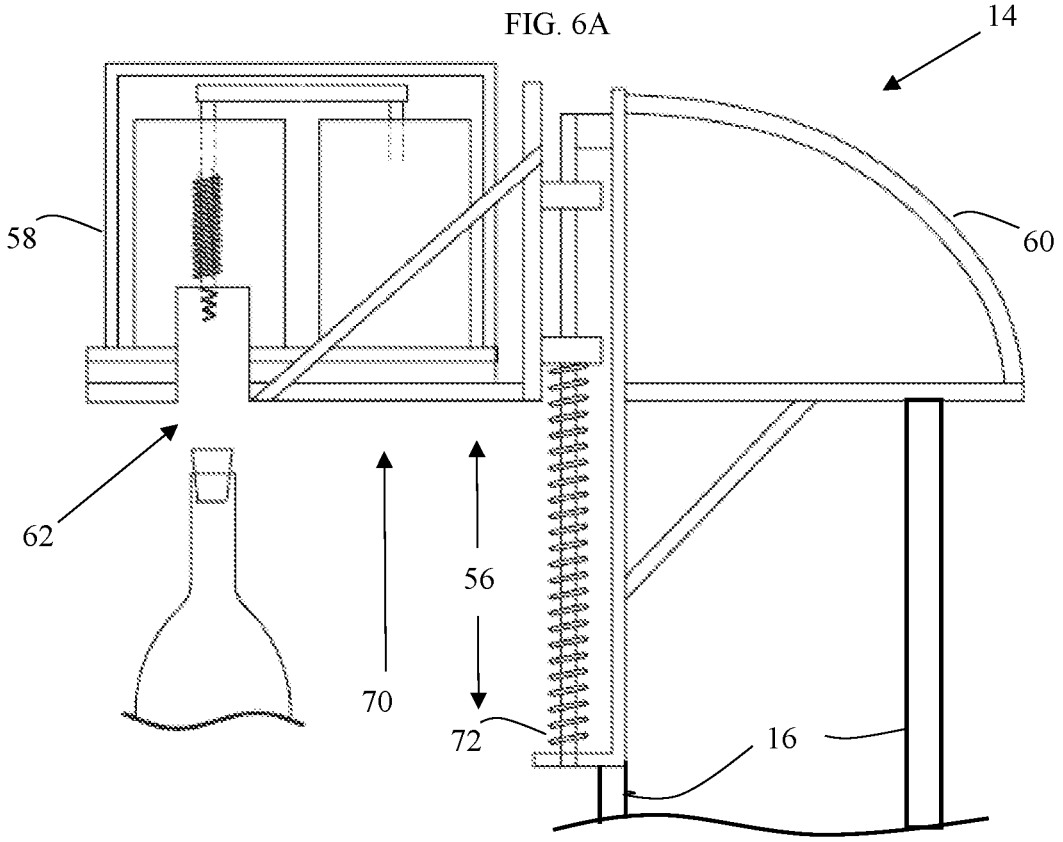
FIG. 6A is side partial cutaway view of the top assembly slidingly engaged with another portion of the top assembly in an upper position according to embodiments disclosed herein.
Figure 6B:
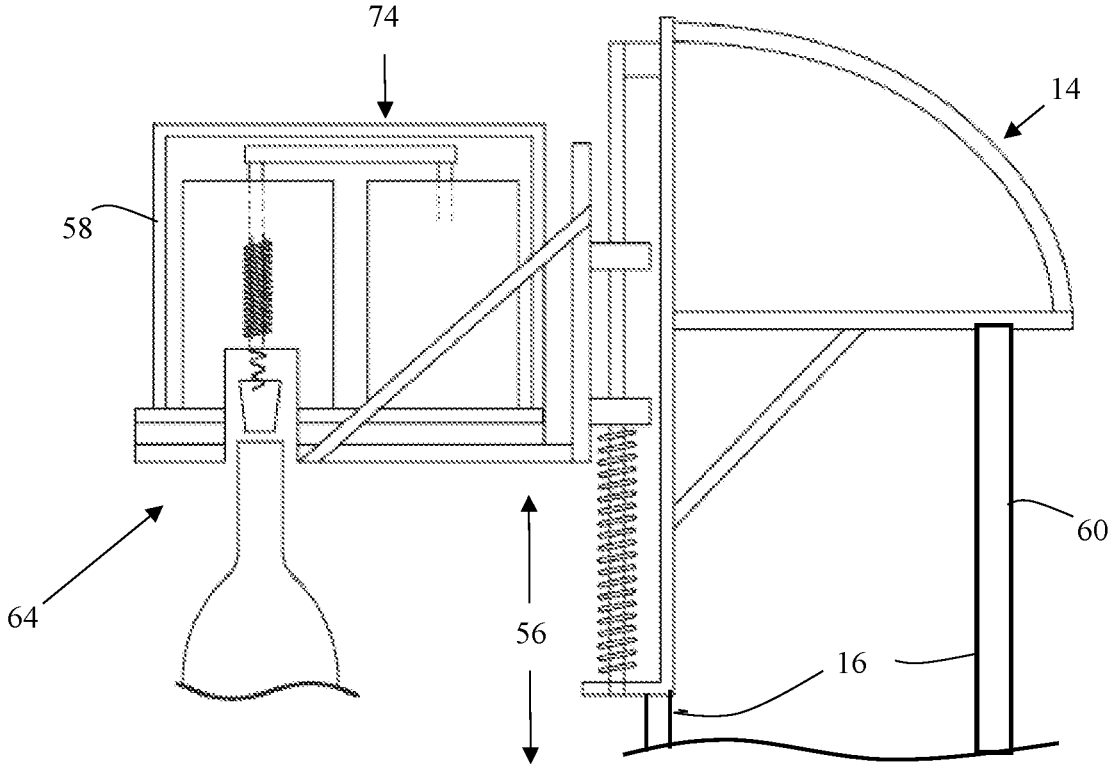
FIG. 6B is side partial cutaway view of the top assembly slidingly engaged with another portion of the top assembly in a lower position according to embodiments disclosed herein.

As shown in FIGS. 6A and 6B, in embodiments, at least a portion 58 of the top assembly 14 is movably engaged 56 with another portion 60 of the top assembly and/or at least one support member 16, such that at least a portion of the top assembly 58, i.e., movable portion 58, is movable between an upper position 62 shown in FIG. 6A relative to the base 12, and a lower position shown in FIG. 6B, in which the movable portion 58 is closer to the base 12 compared to the upper position.

In embodiments, the movable portion 58 of the top assembly movably engaged with another portion, i.e., the stationary portion 60 of the top assembly 14 and/or at least one support member 16 is biased (represented by arrow 70 by a resilient member 72, e.g., a spring, such that in the absence of an external force on the movable portion 58 of the top assembly 14 results in the movable portion 58 occupying the upper position 62. Upon application of the external force 74 on the movable portion 58 towards the base (See FIG. 6B), the movable portion 58 moves toward the base to the lower position 64. Removal of the force 74 results in the movable portion 58 returning to the upper position 62.

In embodiments, the top assembly comprises a stationary portion 60 engaged with at least one support member 16, and a movable portion 58 movably engaged 56 with the stationary portion 60. In some embodiments, the movable portion 58 is movably engaged with at least one support member 16.

In embodiments, as shown in FIG. 7, the entire top assembly 14 is movably engaged 56 with at least one support member 16, e.g., via flexible resilient members, and/or movable members 68, which allow the top assembly 14 to move toward and away from the base 12.

In embodiments, the wine bottle opener further comprises an electric power source 76 and/or an electric storage device, i.e., a battery 36, which may be a rechargeable electric storage device, in electrical communication with the control assembly, the uncorking assembly, or both. As shown in FIG. 7, in embodiments the electric power storage device 36 is located on or at least partially within the top assembly 14. In alternative embodiments, the electric power storage device 36 is located on, under, or at least partially within the base 12 (See FIG. 2). This has the benefit of providing stability to the device.

As shown in FIG. 2, in embodiments, the wine bottle opener 10 further comprises at least one adjustable support member 16 having an adjustable length, such that the distance between the base and the top assembly 14 is adjustable between a first distance and at least one second distance greater than the first distance. As shown in FIG. 2, in embodiments, the at least one adjustable support member 16 comprises a releasably engageable telescoping portion 78 allowing for adjustment of the length of the support. As shown in FIG. 2, examples include a spring loaded pin that engages a corresponding hole disposed into the support provides for the engageable adjustment of the height of the top assembly 14 relative to the base 12, and thus relative to the substantially planer portion provided by the platform.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

I claim:

1. A wine bottle opener for removing a cork from a wine bottle, comprising:

a base, and a top assembly engaged with the base by a plurality of support members such that the top assembly is located a distance above the base sufficient to allow a standard wine bottle to be disposed between the base and the top assembly;

the top assembly comprising an uncorking assembly comprising an electric motor mechanically coupled to an uncorking mechanism, wherein the electric motor is arranged proximate to a side of the uncorking mechanism such that the electric motor is not colinear with and/or located directly on top of the uncorking mechanism;

a control assembly in electronic communication with the uncorking assembly suitable to effect and control actuation and operation of the uncorking mechanism; and a platform disposed between the base and the top assembly, comprising a portion positioned directly between the base and the uncorking mechanism dimensioned to allow at least a portion of a bottom of the standard wine bottle to be disposed thereon;

wherein the platform comprises a scale model of at least a portion of a truck motor vehicle, and wherein the platform is at least partially provided by the cargo bed of the truck motor vehicle scale model.

2. The wine bottle opener of claim 1, wherein the portion of the platform positioned directly between the base and the uncorking mechanism.

3. The wine bottle opener of claim 1, wherein the platform is removably engaged with the base.

4. The wine bottle opener of claim 1, wherein at least a portion of the platform is disposed between at least two of the plurality of support members.

5. The wine bottle opener of claim 1, wherein at least a portion of the top assembly is movably engaged with another portion of the top assembly and/or at least one support member, such that at least a portion of the top assembly is movable between an upper position relative to the base, and a lower position which is closer to the base than the upper position.

6. The wine bottle opener of claim 5, wherein the at least a portion of the top assembly movably engaged with another portion of the top assembly and/or at least one support member is biased by a resilient member such that in the absence of an external force on the at least a portion of the top assembly, the top assembly is in the upper position, and upon application of the external force on the at least a portion of the top assembly towards the base, the at least a portion of the top assembly moves toward the base to a lower position.

7. The wine bottle opener of claim 5, wherein the top assembly comprise a stationary portion engaged with at least one support member, and a movable portion movably engaged with the stationary portion.

8. The wine bottle opener of claim 7, wherein the movable portion is movably engaged with at least one support member.

9. The wine bottle opener of claim 5, wherein the entire top assembly is movably engaged with at least one support member.

10. The wine bottle opener of claim 1, further comprising an electric power storage device, a rechargeable electric storage device, or a combination thereof, in electrical communication with the control assembly, the uncorking assembly, or both.

11. The wine bottle opener of claim 10, wherein the electric power storage device is located on, under, or at least partially within the base.

12. The wine bottle opener of claim 10, wherein the electric power storage device is located on or at least partially within the top assembly.

13. The wine bottle opener of claim 1, comprising at least one adjustable support member having an adjustable length, such that the distance between the base and the top assembly is adjustable between a first distance and at least one second distance greater than the first distance.

14. The wine bottle opener of claim 13, wherein the at least one adjustable support member comprises a releasably engageable telescoping portion for adjustment of the length of the support member.

15. A method of opening a wine bottle, comprising:

providing a wine bottle opener according to claim 1;

positioning a wine bottle into the wine bottle opener with a base of the wine bottle on the portion of the platform; and operating the control assembly to uncork the wine bottle.

16. A method of opening a wine bottle, comprising: providing a wine bottle opener according to claim 6; positioning a wine bottle into the wine bottle opener with a base of the wine bottle on the portion of the platform; applying an external force on the at least a portion of the top assembly towards the base such that the at least a portion of the top assembly moves toward the base to a lower position to engage a top of the wine bottle.

17. The method of claim 16, further comprising operating the control assembly to uncork the wine bottle.

* * * * *